US009357319B2

(12) United States Patent
Yoon et al.

(10) Patent No.: US 9,357,319 B2
(45) Date of Patent: May 31, 2016

(54) ELASTIC BODY OF AUDIO ACCESSORY, AUDIO ACCESSORY AND ELECTRONIC DEVICE SUPPORTING THE SAME

(71) Applicant: Samsung Electronics Co., Ltd., Suwon-si, Gyeonggi-do (KR)

(72) Inventors: Byounguk Yoon, Hwaseong-si (KR); Changryong Heo, Suwon-si (KR); Yongsang Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/461,541

(22) Filed: Aug. 18, 2014

(65) Prior Publication Data

US 2015/0063617 A1 Mar. 5, 2015

(30) Foreign Application Priority Data

Aug. 29, 2013 (KR) ..... 10-2013-0102793

(51) Int. Cl.

| | |
|---|---|
| ***H04R 25/00*** | (2006.01) |
| *H04R 1/10* | (2006.01) |
| *H04R 3/00* | (2006.01) |

(52) U.S. Cl.

CPC ..... *H04R 25/652* (2013.01); *H04R 1/1041* (2013.01); *H04R 1/1016* (2013.01); *H04R 3/00* (2013.01); *H04R 25/30* (2013.01); *H04R 2225/025* (2013.01); *H04R 2225/41* (2013.01); *H04R 2430/01* (2013.01); *H04R 2460/15* (2013.01)

(58) Field of Classification Search

CPC ..... H04R 2225/49; H04R 2460/01; H04R 25/60; H04R 25/65; H04R 2460/17; H04R 2225/023; H04R 2225/025; H04R 1/105; H04R 2225/021; H04R 2225/63; H04R 2460/13; H04R 1/1016

USPC ..... 381/318, 322, 324–325, 328, 330, 381/380–381

See application file for complete search history.

(56) References Cited

U.S. PATENT DOCUMENTS

| | | | | |
|---|---|---|---|---|
| 8,107,654 | B2 * | 1/2012 | Edwards et al. | 381/318 |
| 8,270,648 | B2 * | 9/2012 | Murozaki | 381/328 |
| 2006/0029234 | A1 | 2/2006 | Sargaison | |
| 2008/0013767 | A1 | 1/2008 | Olsen et al. | |

(Continued)

FOREIGN PATENT DOCUMENTS

| | | | |
|---|---|---|---|
| KR | 10-2014-0017997 | A | 2/2014 |
| WO | 2006/094502 | A1 | 9/2006 |

OTHER PUBLICATIONS

Headphones, Wikipedia, last modified Sep. 14, 2011, pp. 1-11, http://en.wikipedia.org/wiki/Headphones, retrieved Sep. 15, 2011.

*Primary Examiner* — Suhan Ni

(74) *Attorney, Agent, or Firm* — Jefferson IP Law, LLP

(57) ABSTRACT

An elastic body of an audio accessory is provided. The elastic body includes a cylindrical inner cover, at least one outer cover which is elongated from a top end edge of the cylindrical inner cover to enclose the cylindrical inner cover, the at least one outer cover having at least one inlet which partially exposes at least a part of the cylindrical inner cover, and at least one sensor module disposed on at least one of the cylindrical inner cover and the at least one outer cover and configured to generate a sensor signal related to deformation of the at least one outer cover.

18 Claims, 24 Drawing Sheets

(56) References Cited

U.S. PATENT DOCUMENTS

| | | | |
|---|---|---|---|
| 2009/0226013 | A1 | 9/2009 | Burge |
| 2010/0135517 | A1 | 6/2010 | Murozaki et al. |
| 2011/0222701 | A1 | 9/2011 | Donaldson et al. |
| 2013/0163803 | A1 | 6/2013 | Erdel |
| 2014/0038525 | A1 | 2/2014 | Cha et al. |

* cited by examiner

ELASTIC BODY OF AUDIO ACCESSORY, AUDIO ACCESSORY AND ELECTRONIC DEVICE SUPPORTING THE SAME

CROSS-REFERENCE TO RELATED APPLICATION(S)

This application claims the benefit under 35 U.S.C. §119 (a) of a Korean patent application filed on Aug. 29, 2013 in the Korean Intellectual Property Office and assigned Serial number 10-2013-0102793, the entire disclosure of which is hereby incorporated by reference.

TECHNICAL FIELD

The present disclosure relates to an audio accessory.

BACKGROUND

Audio signal devices have been developed for the purpose of more independent hearing of an audio signal in an open environment or hearing aid. For example, an earphone may be connected with an electronic device wirelessly or wiredly to output an audio signal provided from the electronic device. In addition, a hearing aid is fitted in a user's ear so as to help a user hear an audio signal, for example, by amplifying the audio signal introduced into the user's ear.

A conventional audio signal device has a problem in that, since a user adjusts a volume level manually, it is difficult to hear an audio signal at a good volume level under a circumstance where the user cannot manually adjust the volume in a suitable manner. When the audio signal device is directed away from an ear, the volume of the audio signal may be merely reduced or may not be heard at all. However, in an environment where the audio signal device is in close contact with the ear inadvertently, there is a problem in that a hearing situation which is not desired by the user or which may cause physical damage to the user's hearing may occur.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a device and system of which the volume may be automatically adjusted according to an insertion condition of an audio accessory in an ear.

Another aspect of the present disclosure is to provide a structure of an audio accessory having a shape which allows an insertion condition in an ear to be determined more closely.

Another aspect of the present disclosure is to provide a structure of an audio accessory having a shape improved in sensor placing environment and signal collection environment related to determination of an insertion condition in an ear.

In accordance with an aspect of the present disclosure, an elastic body of an audio accessory is provided. The elastic body includes a cylindrical inner cover, at least one outer cover which is elongated from a top end edge of the cylindrical inner cover to enclose the cylindrical inner cover, the at least one outer cover having at least one inlet which partially exposes at least a part of the cylindrical inner cover, and at least one sensor module disposed on at least one of the cylindrical inner cover and the at least one outer cover and configured to generate a sensor signal related to deformation of the at least one outer cover.

In accordance with another aspect of the present disclosure, an audio accessory is provided. The audio accessory includes an electrically connectable connector, a cable, one end of which is connected with the connector, an audio output module connected with the other end of the cable and configured to output a signal transmitted thereto, and an elastic body configured to enclose the audio output module. The elastic body includes a cylindrical inner cover, at least one outer cover which is elongated from a top end edge of the cylindrical inner cover to enclose the cylindrical inner cover, the at least one outer cover having at least one inlet which partially exposes at least a part of the cylindrical inner cover, and at least one sensor module disposed on at least one of the cylindrical inner cover and the at least one outer cover and configured to generate a sensor signal related to deformation of the at least one outer cover.

In accordance with another aspect of the present disclosure, an electronic device is provided. The electronic device includes a sensor signal reception unit configured to receive a sensor signal, a sensor signal processing unit configured to generate a control signal related to volume adjustment of an audio signal to be output to correspond to the size of the sensor signal, and an audio signal output unit configured to adjust the audio signal to correspond to the control signal provided by the sensor signal processing unit and then output.

According to various embodiments disclosed herein, a stable control of volume condition of an audio accessory according to an inserted state in an ear may be executed.

According to various embodiments disclosed herein, it is possible to provide an audio accessory and device having a shape optimized to determine an inserted state in an ear.

According to various embodiments disclosed herein, it is possible to provide an audio accessory and device which may more closely and correctly determine an inserted in an ear.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
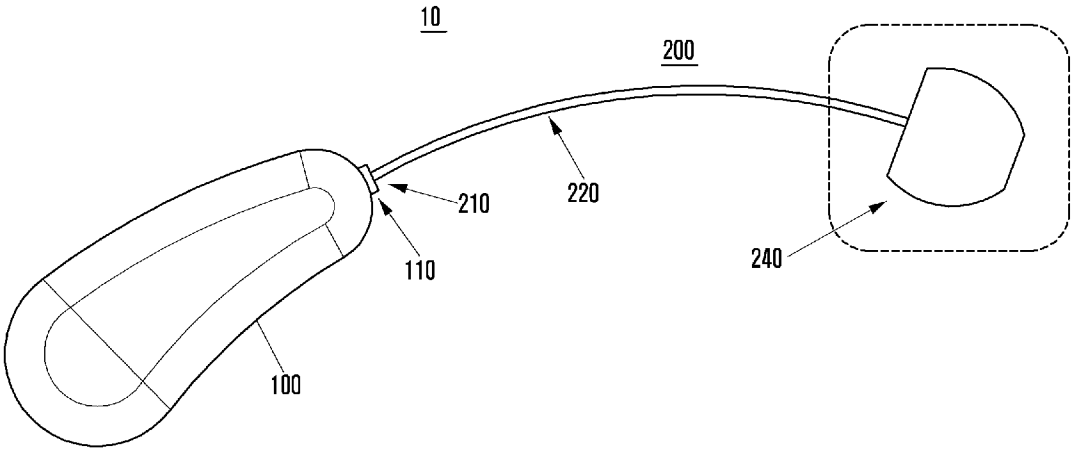
FIG. 1 schematically illustrates a configuration of an audio accessory system according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In describing various embodiments of the present disclosure, a description will be omitted of the technical contents that are well known in the technical field, to which the present disclosure pertains, and are not directly related to the present disclosure. Also, the descriptions of the component elements that have substantially identical configurations and functions will be omitted.

For the same reason, in the accompanying drawings, some elements may be exaggerated, omitted, or schematically illustrated, and a size of each element may not precisely reflect the actual size thereof. Thus, the present disclosure is not limited by the relative size or interval drawn in the accompanying drawings.

An electronic device according to the present disclosure may be a device including a communication function. For example, the electronic device may be one or a combination of a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), an MP3 player, a mobile medical device, an electronic bracelet, an electronic appcessary, a camera, a wearable device, an electronic clock, a wrist watch, a home appliance (for example, refrigerator, air conditioner, cleaner, oven, microwave oven, washing machine, and air cleaner), an artificial intelligence robot, a TeleVision (TV), a Digital Video Disk (DVD) player, an audio player, various types of medical devices (for example, Magnetic Resonance Angiography (MRA), Magnetic Resonance Imaging (MRI), Computed Tomography (CT), scanner, an ultrasonic device, and the like), a navigation device, a Global Positioning System (GPS) receiver, an Event Data Recorder (EDR), a Flight Data Recorder (FDR), a set-top box, a TV box (for example, Samsung HomeSync™ Apple TV™, or Google TV™), an electronic dictionary, a vehicle infotainment device, electronic equipment for a ship (for example, a navigation device for ship, a gyro compass, and the like), avionics, a security device, electronic clothes, an electronic key, a camcorder, game consoles, a Head-Mounted Display (HMD), a flat panel display device, an electronic frame, an electronic album, furniture or a part of buildings/structures having a communication function, an electronic board, an electronic signature receiving device, a wearable device, and a projector. It is obvious to those skilled in the art that the electronic device according to the present disclosure is not limited to the aforementioned devices.

FIG. 1 schematically illustrates a configuration of an audio accessory system according to an embodiment of the present disclosure.

Referring to FIG. 1, an audio accessory system 10 according to an embodiment of the present disclosure may include an audio accessory and an electronic device 100.

The electronic device 100 may receive a signal transmitted by the audio accessory 200 and process the signal. In addition, the electronic device 100 may transmit a signal related to a sensor control to the audio accessory 200. The electronic device 100 may include, for example, a sensor signal reception unit, a sensor signal processing unit (not shown), and an audio signal output unit (not shown). The sensor signal reception unit may receive a sensor signal from the audio accessory 200. The sensor signal processing unit may generate a control signal which is related to the volume adjustment of the audio accessory in response to the magnitude of the sensor signal. The audio signal output unit may be controlled to adjust an audio signal generated by the electronic device 100 or a collected audio signal in response to a control signal provided by the sensor signal processing unit and then transmit the adjusted audio signal to the audio accessory 200. When the audio accessory 200 includes a battery, the electronic device 100 may support the battery charge of the audio accessory 200. In addition, when the audio accessory 200 does not include a battery, the electronic device 100 may supply power required for driving the audio accessory 200.

According to various embodiments, the electronic device 100 may receive the sensor signal from the audio accessory 200. The electronic device 100 may support a situation recognition function of the audio accessory 200 according to the received sensor signal. For example, the electronic device 100 may automatically adjust the magnitude of the audio signal output by the audio accessory 200. According to an embodiment, upon receiving a first sensor signal from the audio accessory 200, the electronic device 100 may perform a control such that an audio signal having a first volume magnitude defined in advance is output through the audio accessory 200 in response to the first sensor signal. According to another embodiment, upon receiving a second sensor signal from the audio accessory 200, the electronic device 100 may perform a control such that an audio signal having a second volume magnitude defined in advance is output through the audio accessory 200 in response to the second sensor signal. The electronic device 100 may automatically execute various circumstance recognition functions, for example, volume control of an audio signal to be output by the audio accessory 200 in response to the magnitudes of various sensor signals received from the audio accessory 200.

According to various embodiments, when the audio accessory 200 is an earphone device, the electronic device 100 may automatically adjust the magnitude of an audio signal to be output through the earphone in response to a sensor signal provided by the earphone device. For example, electronic device 100 may automatically adjust the volume of an audio signal to be transmitted to the earphone device in response to an inserted position of a header of the earphone device in an ear. According to an embodiment, when the header of the earphone device is closer to the eardrum, the electronic device 100 may perform a control to reduce the magnitude of the volume of an audio signal to be output through the earphone device. According to another embodiment, when a distance between the header of the earphone device and the eardrum is within a predetermined distance, the electronic device 100 may perform a control to stop the output of the audio signal. According to still another embodiment, when the header of the earphone device is farther apart from the eardrum, the electronic device 100 may perform a control to increase the magnitude of the volume of the audio signal. According to yet another embodiment, when the earphone device is released from the inside of the ear, the electronic device 100 may perform a control to stop the output of the audio signal. In addition, the electronic device 100 may perform a control to temporarily stop file reproduction related to the audio signal being output to the earphone device, temporarily stop the file reproduction and then terminate the file reproduction when a predetermined length of time elapses, or terminate the file reproduction.

According to various embodiments, when the audio accessory 200 is a hearing aid, the electronic device 100 may differently adjust the magnitude of a signal amplified by the hearing aid. For example, the electronic device 100 may differently adjust the signal amplification magnitude of the hearing aid in response to the inserted position of the hearing aid in an ear. According to an embodiment, when the hearing aid is positioned closer to the eardrum side with reference to the earflap, the electronic device 100 may perform a control to reduce the amplification level of the hearing aid. According to another embodiment, when it is determined that the distance between the hearing aid and the ear drum is within a predetermined distance, the electronic device 100 may perform a control to turn off the hearing aid. According to another embodiment, when the hearing aid is farther away from the eardrum, the electronic device 100 may control the hearing aid to increase the amplification level of the hearing aid. According to still another embodiment, when the hearing aid is released from the inside of the ear, the electronic device 100 may control the hearing aid such that the hearing aid stops its operation or is turned off According to yet another embodiment, when the hearing aid is inserted into the ear, the electronic device 100 may control the hearing aid such that the hearing aid is turned on.

The above-described electronic device 100 may be any of various electronic devices. For example, the electronic device 100 may a portable electronic device or a smart phone device. The electronic device 100 may include a connection unit 110 into which a connector 210 of an audio accessory 200 may be inserted. The connection unit 110 may be configured to be temporally fixed after the connector 210 is inserted. For example, the connection unit 110 may have a hollow cylindrical shape. In addition, the connection unit 110 may have a hollow polygonal shape such as a rectangular shape. The connection unit 110 may be implemented in a shape in which a separate pin is provided in the inside thereof or at least one terminal is provided on an inner wall thereof.

The audio accessory 200 may be connected to the electronic device 100. The audio accessory 200 may output an audio signal provided by the electronic device 100 or amplify audio signals collected from the outside. For example, the audio accessory 200 may be an earphone device that outputs an audio signal transmitted from the electronic device 100. The audio accessory 200 may be an hearing aid that amplifies an audio signal transmitted from the outside and outputs the amplified audio signal according to the control of the electronic device 100. The audio accessory 200 may include a connector 210, a cable 220, and a header module 240.

The connector 210 may be connected with the connection unit 110 formed on the electronic device 100. The connector 210 may be connected with the electronic device 100 to transmit at least one of a signal and power provided by the electronic device 100 to the header module 240 through the cable 220. The connector 210 may be formed variously according to a designer's intention. For example, the connector 210 may take various shapes such as a cylindrical jack shape or a rectangular parallelepiped jack shape. The connector 210 may be provided with at least one terminal on a surface thereof or include at least one pin that serves as a terminal. The connector 210 may be inserted into the connection unit 110 of the electronic device 100 to be electrically connected and to form a communication contact. The connector 210 may be press-fitted into the connection unit 110 such that the connector 210 may be temporally fixed after being inserted into the connection unit 110. In addition, the connector 210 may be hooked to the connection unit 110. The connector 210 may be connected with one end of the cable 220.

The cable 220 interconnects the connector 210 and the header module 240. In the drawing, the length and width of the cable 220 is illustrated by way of an example. The length and thickness of the cable 220 may be variously designed according to the purpose of the audio accessory 200. The cable 220 may include at least one signal line therein. The cable 220 may include a sheath of a predetermined thickness so as to protect the at least one signal line.

The header module 240 may be connected with the other end of the cable 220. The header module 240 may output an audio signal transmitted through the cable 220. At this time, the header module 240 may include a signal amplification module according to a design method. When the header module 240 includes the signal amplification module, the header module 240 may amplify and output the transmitted audio signal. At least a part of the header module 240 may be inserted into and disposed within the user's ear.

Figure 2:
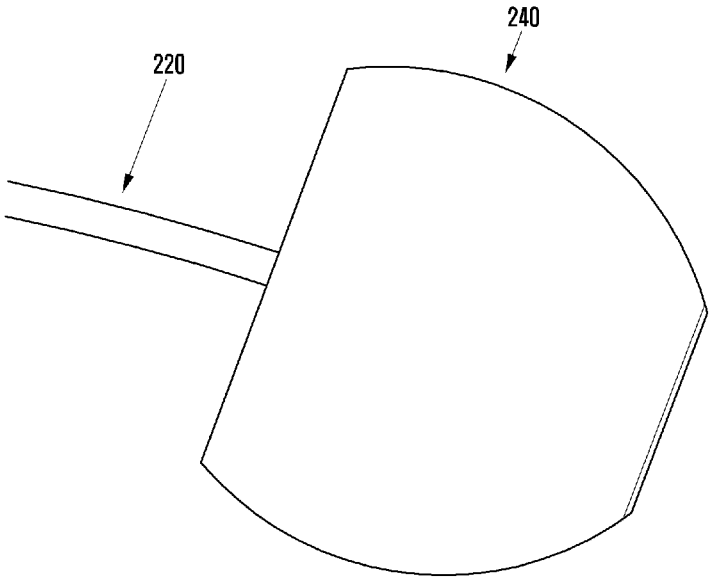
FIG. 2 illustrates a header module area of an audio accessory device in more detail according to an embodiment of the present disclosure.
Figure 3:
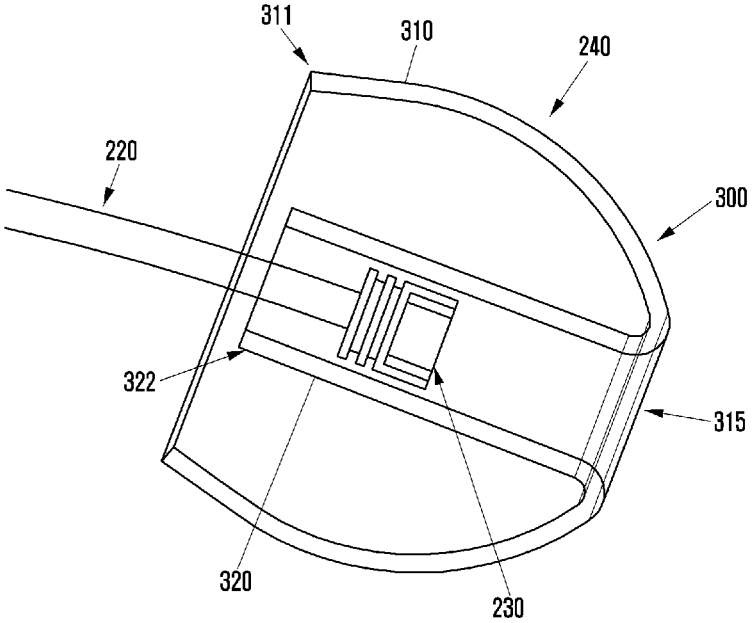
FIG. 3 illustrates a section of a header module of an audio accessory device according to an embodiment of the present disclosure.

FIG. 2 illustrates the header module area of the audio accessory device in more detail according to an embodiment of the present disclosure. FIG. 3 illustrates a section of the header module of the audio accessory device according to an embodiment of the present disclosure.

Referring to FIGS. 2 and 3, the header module 240 may be provided in a spherical shape of which the outer portion is partially removed. The header module 240 may generally include an elastic body 300 and an audio output module 230.

The elastic body 300 of the audio accessory 200 may include a cylindrical inner cover 320, and an outer cover 310 formed to extend from an top end edge of the inner cover 320 and wrap the inner cover 320 and having an inlet configured to a part of the inner cover 320. In addition, the elastic body 300 may include a sensor module disposed on at least a portion of the inner cover 320 and the outer cover 310 to generate a sensor signal corresponding to the deformation of the outer cover 310.

The outer cover 310 has a predetermined thickness and may be provided in a hollow shape which is partially removed. For example, the outer cover 310 may include an inlet 311 formed by a side of the outer cover 310, and a sound hole 315 positioned on an axis parallel to the inlet 311 and having a size which is not larger than that of the inlet 311. Here, the shape of the inlet 311 does not limit the various embodiments of the present disclosure. The inlet 311 may be formed in various shapes and sizes.

The outer cover 310 may be provided by a surface connecting the edge of the sound hole 315 and the edge of the inlet 311. An area of the outer cover 310 where the sound hole 315 is positioned may be formed to have a diameter smaller than the inlet 311 such that the area may be easily inserted into the ear. For example, the outer cover 310 of the elastic body 300 may be formed in a shape of which the sectional size is gradually increased from the edge of the sound hole 315 toward the edge of the inlet 311. Alternatively, the outer cover 310 of the elastic body 300 may be formed in a shape in which the sectional size of the area from the edge of the sound hole 315 to the edge of the inlet 311 is gradually increased to a predetermined distance and, after the predetermined distance, the sectional size is gradually decreased. According to an embodiment, the outer cover 310 of the elastic body 300 may be provided in a shape bent from the edge of the sound hole 315 to the edge of the inlet 311. The outer cover 310 may be formed of various elastic materials such as rubber, polyurethane, and synthetic resin. The edge of the sound hole 315 of the outer cover 310 may be rounded.

The inner cover 320 may have a predetermined thickness and be formed in a hollow cylindrical shape. The entire length of the inner cover 320 may be shorter than one side length of the outer cover 310. Alternatively, according to the designer's intention, the entire length of the inner cover 320 may be longer than the one side length of the outer cover 310. For example, a part of the inner cover 320 may protrude from the inlet 311 of the outer cover 310. The top end edge of the inner cover 320 may be connected with the sound hole 315 of the outer cover 310. On one side of the inner cover 320, the audio output module 230 may be seated. The inner cover 320 may be formed of a material which is the same as that of the outer cover 310. Alternatively, the inner cover 320 may be formed of various materials which are different from that of the outer cover 310, for example, a plastic material and wood. A fixing unit that supports the fixation of the audio output module 230 may be provided in a predetermined inner area of the inner cover 320. The inner cover 320 also includes a bottom surface 322.

The audio output module 230 may output an audio signal transmitted through the cable 220. The audio output module 230 may be disposed inside the inner cover 320. The audio output module 230 may be provided in, for example, a cylindrical shape but is not limited thereto. When outputting the audio signal transmitted through the cable 220, the audio output module 230 may amplify the audio signal. In such a case, the audio output module 230 may include a signal amplification circuit or a signal amplification module. The signal amplification module disposed on the audio output module 230 may automatically adjust a signal amplification level in response to the sensor signal transmitted in relation to the disposed position of the header module 240 within the ear. For example, the signal amplification module of the audio output module 230 may reduce the signal amplification level when the header module 240 is positioned adjacent to the eardrum within the ear and increase the signal amplification level when the header module 240 is positioned away from the eardrum in the ear.

The header module 240 may include a sensor module configured to generate a sensor signal corresponding to the deformation of the outer cover of the elastic body 300, for example, a distance sensing module. The distance sensing module senses the change in shape of the header module 240 and transmits a sensed sensor signal to the signal amplification module of the audio output module 230. The arrangement and operation of the distance sensing module will be described in detail below with reference to drawings.

Figure 4A:
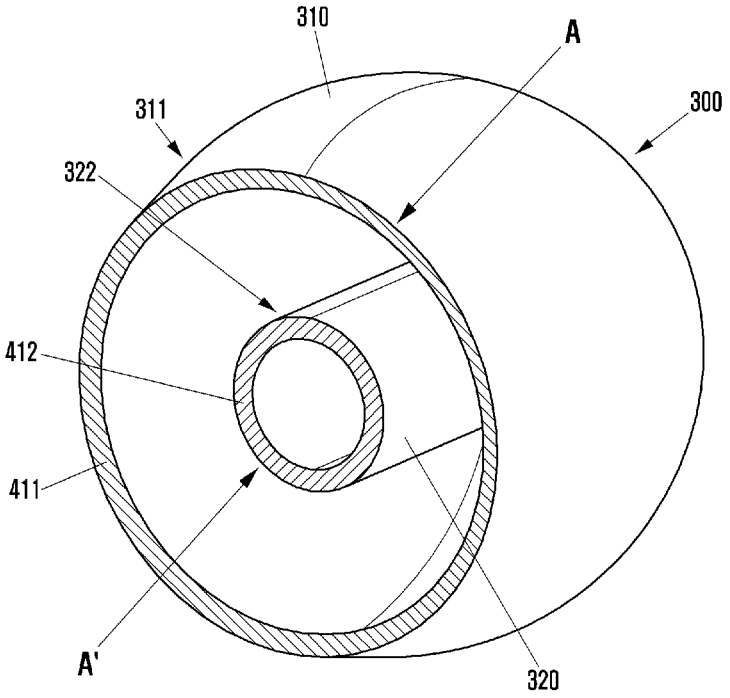
FIGS. 4A and 4B are views for describing a distance sensing module according to an embodiment of the present disclosure.
Figure 4B:
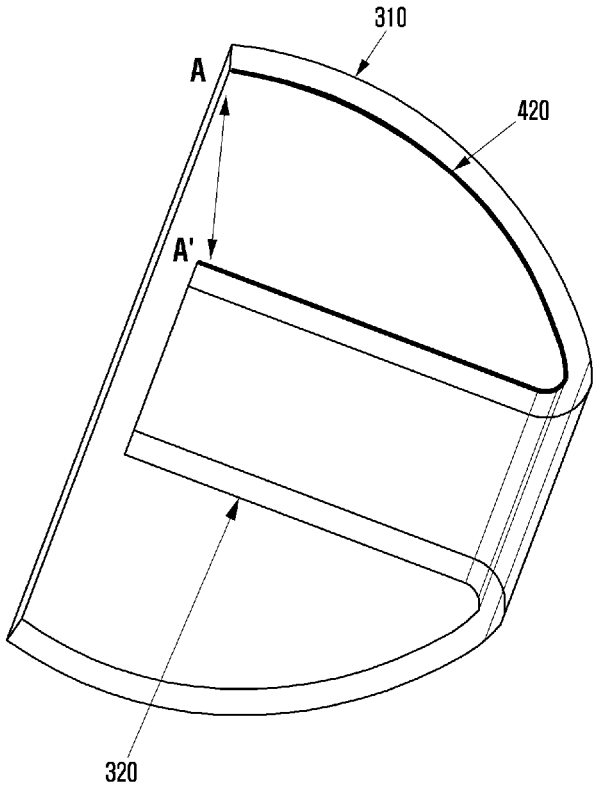

FIGS. 4A and 4B are views for describing a distance sensing module according to an embodiment of the present disclosure.

First, referring to FIG. 4A, the distance sensing module may include a deformation unit 411 disposed on the edge of the inlet 311 of the outer cover 310 of the elastic body 300, and a reference unit 412 disposed on the edge of the bottom surface 322 of the inner cover 320. In addition, the distance sensing module may include at least one of a first signal line connected to the deformation unit 411 and a second signal line connected to the inner cover 320.

The deformation unit 411 may be a circular band shape having a predetermined thickness. The deformation unit 411 may suffer from a change in shape or position due to the physical change of the outer cover 310 while the header module 240 is being inserted in an ear. For example, at least a part of the deformation unit 411 may be moved toward a position near to the reference unit 412 in response to the distortion of the outer cover 310 or the like. According to another embodiment, another part of the deformation unit 411 may be disposed at a position which may be moved away from the reference unit 412 in response to the distortion of the outer cover 310 or the like. According to various embodiments, a plurality of deformation units 411 may be arranged on at least a part of the edge of the inlet 311 of the outer cover 310. For example, the deformation units 411 may be formed only on a semi-circular edge portion in the edge of the inlet 311. However, in connection with sensing the distance between the deformation unit 411 and the reference unit 412 (i.e., A to A'), the deformation unit 411 may be provided at a position on the inlet 311 aligned with the reference unit 412. The deformation unit 411 may be formed of a material capable of transmitting or storing an electrical signal, for example, a metallic material.

The reference unit 412 may be formed on at least a part of the bottom surface of the inner cover 320. For example, the reference unit 412 may be formed at a position which is opposite to a position where the sound hole 315 is formed. The reference unit 412 may be provided in connection with sensing the distance to the reference unit 412. When the deformation unit 411 is deformed due to the distortion of the outer cover 310, the distance between the deformed deformation unit 411 and the reference unit 412 may be changed. The reference unit 412 may collect sensor signal values according to the distance change and transmit the sensor signal values to the audio output module 230, or to the electronic device 100 through the second signal line. The reference unit 412 may be formed of a material which is the same as or similar to that of the deformation unit 411.

According to an embodiment, the deformation unit 411 and the reference unit 412 may be implemented using a sensor that supports the distance sensing according to a change of capacitance. In such a case, each of the deformation unit 411 and the reference unit 412 may serve as a current collection body charged with positive charges or negative charges, and the first signal line and the second signal line may be connected to the deformation unit 411 and the reference unit 412 to transmit a change in charge amount according to the change of distance between the deformation unit 411 and the reference unit 412 to the audio output module 230 or the electronic device 100.

Referring to FIG. 4B, the distance sensing module may include a sensing unit 420 formed on the inner surface of the outer cover 310 by a predetermined length in the width direction and then formed on the outer surface of the inner cover 320 by a predetermined length in the width direction. A part ("first portion") of the sensing unit 420 is formed on the inner surface of the outer cover 310 and may include a remaining part ("second portion") connected to the first portion formed on the outer cover 310 and formed on the outer surface of the inner cover 320. The sensing unit 420 may generate a sensor signal according to the change of distance between an end of the first portion of the sensing unit 420 and the second portion of the sensing unit 420 in response to the deformation of the elastic body 300, and transmit the sensor signal to the audio output module 230 or the electronic device 100.

The distance sensing module may include a third signal line connected with the sensing unit 420 to transmit the sensor signal. The third signal line may be a signal line that transmits the sensor signal generated according to the change of distance of the distance sensing module to the audio output module 230 or the electronic device 100. When the audio output module 230 to which the sensor signal is transmitted is disposed inside the inner cover 320, the third signal line may be formed through the inner cover 320. When the electronic device 100, to which the sensor signal is transmitted, is separately provided, the third signal line may be connected to the cable 220 of the audio accessory 200 through the bottom surface of the inner cover 320. The cable 220 may be provided with an extension line of the third signal line. The third signal line may be connected to the signal processing module of the electronic device 100.

According to an embodiment, the sensing unit 420 may be disposed inside the elastic body 300 as illustrated. In addition, the sensing unit 420 may suffer from a shape change due to the deformation of the outer cover 310. For example, the sensing unit 420 may suffer from a change in elasticity due to the deformation of the outer cover 310. The sensing unit 420 may transmit a sensor signal corresponding to the changed elasticity to at least one of the audio output module 230 and the electronic device 100 through the third signal line. Based on the change of elasticity, at least one of the audio output module 230 and the electronic device 100 may determine how deeply the elastic body 300 is moved within the ear. Alternatively, according to the change of elasticity, at least one of the audio output module 230 and the electronic device 100 may estimate the distance between the ends of the first and second portions of the sensing unit 420, and estimate the position of the elastic body 300 within the ear based on the estimated distance.

Figure 5A:
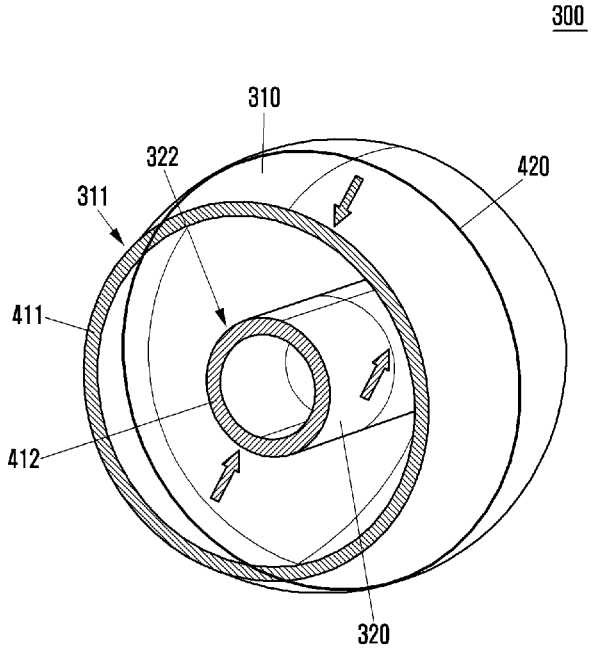
FIGS. 5A and 5B illustrate arranged forms of a plurality of distance sensing modules according to an embodiment of the present disclosure.
Figure 5B:
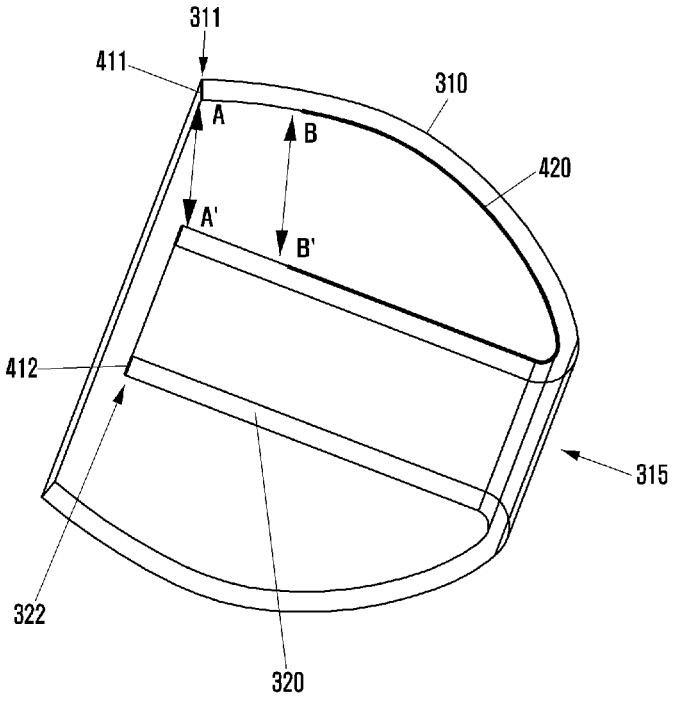

FIGS. 5A and 5B illustrate arranged forms of a plurality of distance sensing modules.

Referring to FIGS. 5A and 5B, the elastic body 300 may include a first distance sensing module and a second distance sensing module disposed inside the elastic body 300.

The first distance sensing module may include the deformation unit 411 and the reference unit 412 disposed on the inlet 311 of the outer cover 310 and the bottom surface 322 of the inner cover 320, respectively, as described above with reference to FIG. 4A. In addition, the first distance sensing module may include the first signal line connected with the deformation unit 411, and the second signal line connected with the reference unit 412. The deformation unit 411 may be formed on at least one location on the edge of the inlet 311 or a plurality of deformation units 411 may be provided on the edge of the inlet 311 to be spaced apart from each other at predetermined intervals. The reference unit 412 may also be formed on at least one location on the edge of the bottom surface 322 of the inner cover 320 or a plurality of reference units 412 may be provided on the edge of the bottom surface 322 to be spaced apart from each other at predetermined intervals. When the plurality of deformation units 411 and the plurality of reference units 412 are disposed on the inlet 311 and the bottom surface 322, respectively, a plurality of first signal lines and a plurality of second signal lines may be provided.

The second distance sensing module is disposed inside the elastic body 300 to be spaced apart from the first distance sensing module by a predetermined distance (e.g., B and B'). For example, the second distance sensing module may be configured using the sensing unit 420 in which one end of the sensing unit 420 may be disposed at a position spaced apart from the inlet 311 of the outer cover 310 by a predetermined distance toward the sound hole 315 and the other end may be disposed at a position spaced apart from the bottom surface 322 of the inner cover 320 by a predetermined distance in a distance where the sound hole 315 is formed.

When a physical force is applied to and deforms the outer cover 310 of the elastic body 300, the deformation unit 411 and the one end of the sensing unit 420 provided on the outer cover 310 may be deformed. For example, at least a part of the deformation unit 411 may be positioned at a position which is moved closer to the reference unit 412 as compared to the prior position (e.g., A and A'). At the position where the spaced distance is reduced, the spaced distance between the opposite ends of the sensing unit 420 may also be reduced. The signal lines provided in the elastic body 300 may transmit a sensor signal generated by the physical deformation of the outer cover 310 to at least one of the audio output module 230 and the electronic device 100 to correspond to the designed forms thereof.

FIGS. 6A to 6D are views for describing a deformation of the elastic body according to various embodiments of the present disclosure.

Figure 6A:
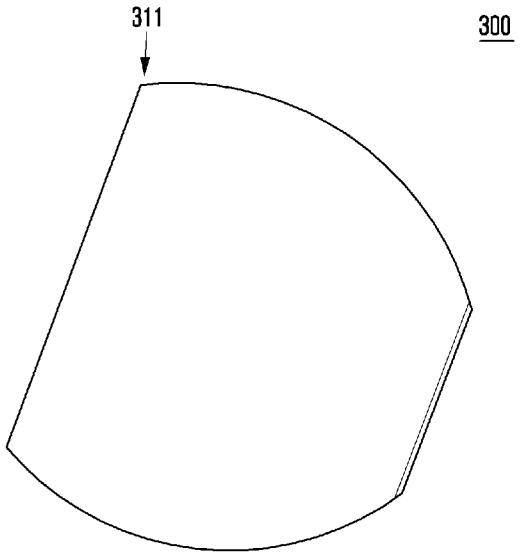
FIGS. 6A, 6B, 6C, and 6D are views for describing a deformation of an elastic body according to an embodiment of the present disclosure.
Figure 6B:
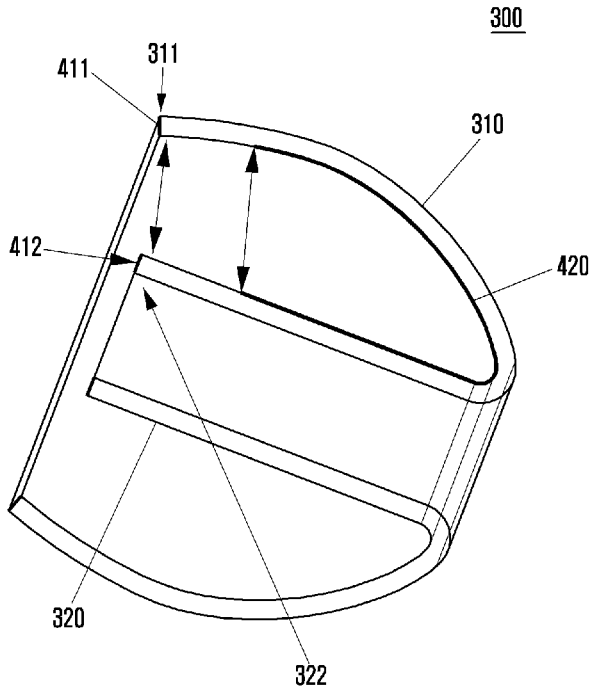

First, the elastic body 300 illustrated in FIGS. 6A and 6B may be in a state where no specific physical force is applied thereto. For example, the elastic body 300 may be in a relaxed state. When the elastic body 300 is in the relaxed state, the distance between the inlet 311 provided in the outer cover 310 and the bottom surface 322 provided in the inner cover 320 may have a first distance value. According to various embodiments, the deformation unit 411 provided on the inlet 311 and the reference unit 412 provided on the bottom surface 322 may generate a sensor signal corresponding to the first distance value. In addition, the one end of the sensing unit 420 provided at a predetermined point inside the outer cover 310 and the other end of the sensing unit provided at a predetermined point outside the inner cover 320 may have a second distance value. The sensing unit 420 may generate a sensor signal corresponding to the second distance value.

Figure 6C:
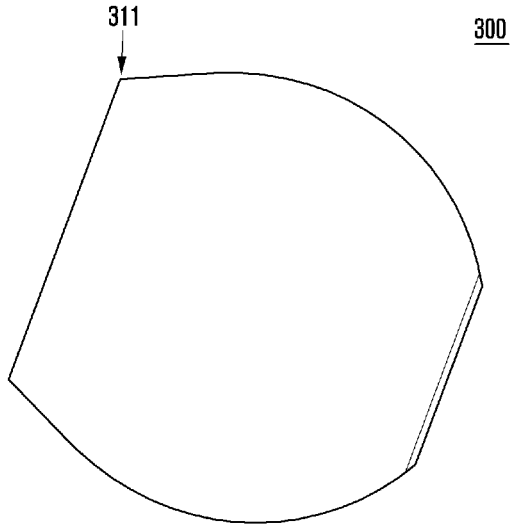
Figure 6D:
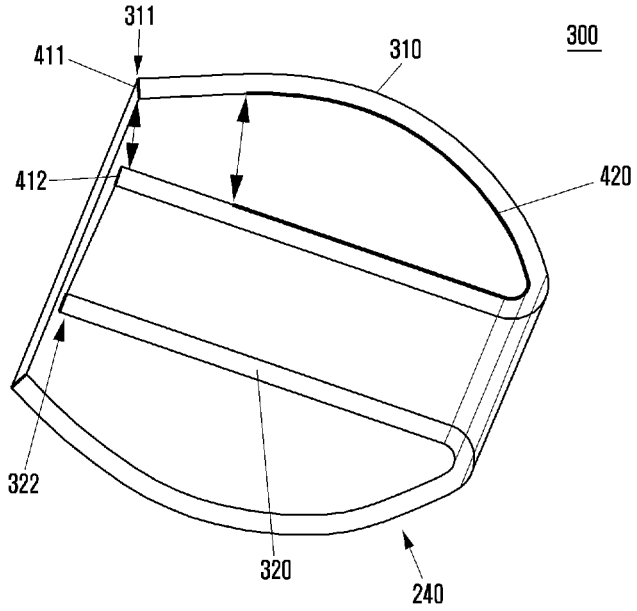

Referring to FIGS. 6C and 6D, when the user grips the header module 240 or inserts the header module 240 into an ear, a physical force may be applied to the elastic body 300 of the header module 240. Then, the elastic body 300 of the header module 240 may be deformed in appearance by the applied physical force. For example, the elastic body 300 may be in a contracted state. When the elastic body 300 is contracted, at least a part of the outer cover 310 of the elastic body 300 may have a distorted form. According to various embodiments, in response to the contraction of the elastic body 300, a spaced distance between at least a part of the inlet 311 of the outer cover 310 and the bottom surface 322 of the inner cover 320 is reduced to have a third distance value. The deformation unit 411 provided on the inlet 311 and the reference unit 412 provided on the bottom surface 322 may generate a sensor signal corresponding to the third distance value. In addition, the distance between the one end of the sensing unit 420 provided at a predetermined point inside the outer cover 310 and the other end of the sensing unit 420 provided at a predetermined point outside the inner cover 320 may be reduced more than before and may have a fourth distance value. The sensing unit 420 may generate a sensor signal corresponding to the fourth distance value.

As described above, the physical deformation of the elastic body 300 may be caused due to an external pressure. The audio output module 230 and the electronic device 100 may determine that an effective sensor signal is received when the sensor signal related to the physical deformation is maintained at a predetermined value. Through this, at least one of the audio output module 230 and the electronic device 100 may invalidate a sensor signal corresponding to a state where the audio accessory 200 is merely gripped. In addition, at least one of the audio output module 230 and the electronic device 100 may validate a sensor signal in an environment where the header module 240 is maintained for a predetermined length of time after being inserted into the ear. According to various embodiments, when a sensor signal is generated according to the positional change in the ear after it is determined that the elastic body 300 is in the environment where it is inserted into the ear, at least one of the audio output module 230 and the electronic device 100 may apply a situation recognition function, for example, an automatic audio volume adjustment function, at the time point when the corresponding signal is received. Through this, the audio accessory 200 of the present disclosure may perform adaptive volume adjustment corresponding to the position of the header module 240 within the user's ear so as to protect the user's hearing ability and provide a suitable volume magnitude. When the elastic body 300 of the header module 240 is shifted from the relaxed state to the contracted state, at least one of the audio output module 230 and the electronic device 100 may determine the state as an effective state when the contracted state is maintained for a predetermined length of time as described above, and execute a situation recognition function corresponding thereto.

Figure 7A:
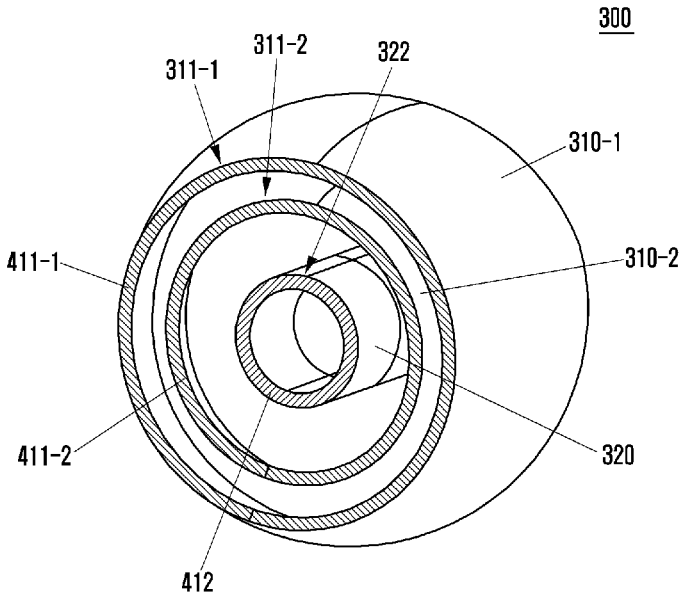
FIGS. 7A and 7B are views for describing a shape of an elastic body according to an embodiment of the present disclosure.
Figure 7B:
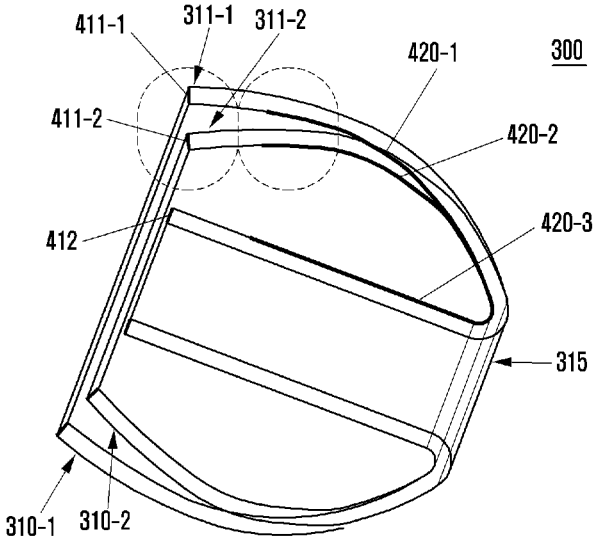

FIGS. 7A and 7B are views for describing a shape of an elastic body according to an embodiment of the present disclosure.

Referring to FIGS. 7A and 7B, an elastic body 300 may include a first outer cover 310-1, a second outer cover 310-2, and an inner cover 320.

The first outer cover 310-1 and the second outer cover 310-2 may be formed to extend from the same sound hole 315. For example, the first outer cover 310-1 may have a predetermined thickness and be provided in a hollow spherical shape of which a part is removed. The first outer cover 310-1 may include a first inlet 311-1, and the sound hole 315 positioned on an axis parallel to the first inlet 311-1, in which the sound hole 315 may have a size smaller than that of the first inlet 311-1. The first outer cover 310-1 may be provided as a surface extending from an edge of the sound hole 315 to an edge of the first inlet 311-1.

The second outer cover 310-2 may also have a predetermined thickness and be provided in a hollow spherical shape of which a part is removed. The second outer cover 310-2 may be provided inside the first outer cover 310-1. The second outer cover 310-2 may include a second inlet 311-2 and the sound hole 315. The sound hole 315 may be a sound hole which is the same as the sound hole 315 formed in the first outer cover 310-1. The second inlet 311-2 may be disposed closer to the sound hole 315, as compared to the first inlet 311-1. However, various embodiments of the present disclosure are not limited to this. For example, with reference to the position where the sound hole 315 is formed, the second inlet 311-2 may be positioned farther away from the sound hole 315, as compared to the first inlet 311-1, and protrude from the first inlet 311-1.

The inner cover 320 may be provided in a cylindrical shape inside the second outer cover 310-2. The top end surface of the inner cover 320 forms the sound hole 315. The inner cover 320 may be disposed on the same axis as the second outer cover 310-2 and the first outer cover 310-1. With reference to the sound hole 315, the bottom surface 322 of the inner cover 320 may be positioned closer to the sound hole 315, as compared to the second inlet 311-2 of the second outer cover 310-2. However, various embodiments of the present disclosure are not limited to this, and the bottom surface 322 of the inner cover 320 may be provided to protrude from the second inlet 311-2 according to the designer's intention.

On the first inlet 311-1 of the first outer cover 310-1, a first deformation unit 411-1 may be disposed. On the second inlet 311-2 of the second outer cover 310-2, a second deformation unit 411-2 may be disposed. On the bottom surface 322 of the inner cover 320, a reference unit 412 may be provided. When the elastic body 300 is physically deformed, the distance between the first deformation unit 411-1 and the reference unit 412 and the distance between the second deformation unit 411-2 and the reference unit 412 may be different from each other. In addition, a phase difference may occur between the first deformation unit 411-1 and the second deformation unit 411-2.

A first line 420-1 of the sensing unit 420 may be provided on the inner surface of the first outer cover 310-1. A second line 420-2 of the sensing unit 420 may be provided on the inner surface of the second outer cover 310-2. The first line 420-1 and the second line 420-2 may be connected to each other in the vicinity of the position where the sound hole 315 is disposed, and connected with a third line 420-3 formed on the outer surface of the inner cover 320. When a physical force is applied to the elastic body 300, the first outer cover 310-1 and the second outer cover 310-2 may be physically deformed. In response to this, the sensing unit 420 may suffer from a change in the distance between the first and second lines 420-1 and 420-2 and the third line 420-3. Further, the sensing unit 420 may suffer from a change in the distance between the first line 420-1 and the second line 420-2.

At least one of a sensor signal corresponding to the change in the distance between the first and second deformation units 411-1 and 411-2 and the reference unit 412 and a sensor signal corresponding to the change in distance of the sensing unit 420 may be transmitted to at least one of the audio output module 230 and the electronic device 100. In connection with this, the elastic body 300 may further include a signal line capable of transmitting the sensor signals.

Figure 8:
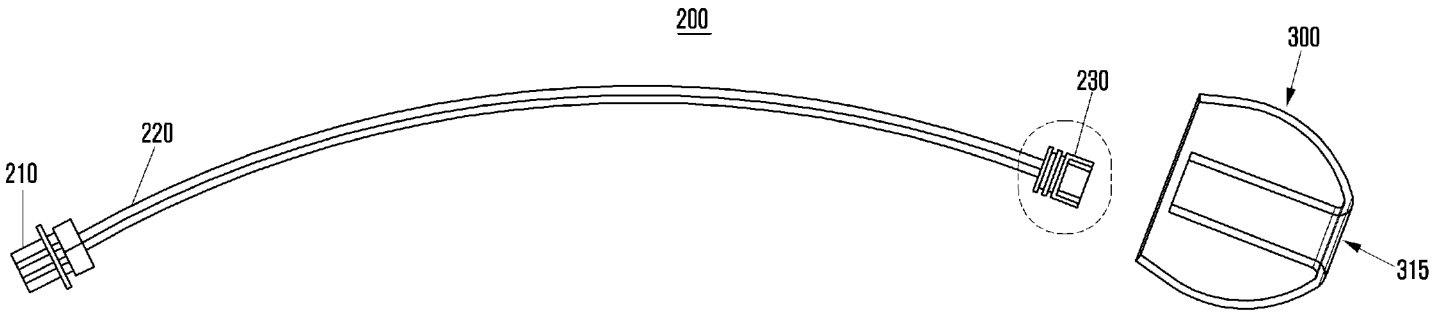
FIG. 8 is a view illustrating a shape of an audio accessory according to an embodiment of the present disclosure.

FIG. 8 is a view illustrating a shape of an audio accessory according to an embodiment of the present disclosure.

Referring to FIG. 8, an audio accessory 200 may be provided in a form in which an elastic body 300 and an audio output module 230 are separated from each other to be coupled to each other. For example, a connector 210, a cable 220, and an audio output module 230 may be integrally provided. The elastic body 300 may be provided through a separate injection molding process and the like. The audio output module 230 may be fixedly inserted into an inner cover 320 of the elastic body 300. Alternatively, the cable 220 and the audio output module 230 may be integrally provided and then the cable 220 is inserted toward a sound hole 315 of the elastic body 300, so that the audio output module 230 may be disposed at a predetermined position in the inner cover 320 of the elastic body 300. In addition, the connector 210 is connected to the other end of the cable 220 so as to provide the audio accessory 200. Since such a separated configuration is provided such that the elastic body 300, the audio output module 230, and the like. are separable from each other, a specific component may be easily replaced when it is damaged or abnormality occurs therein.

Figure 9:
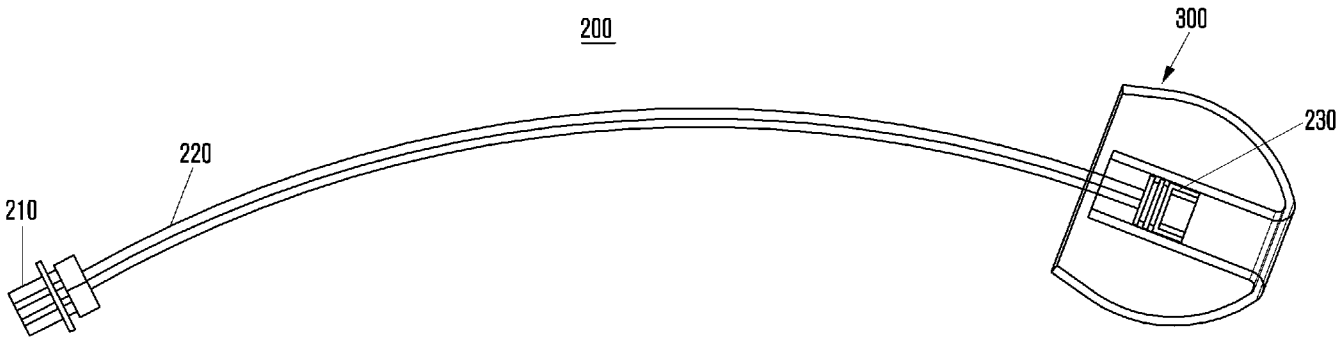
FIG. 9 is a view for describing a shape of an audio accessory according to another embodiment of the present disclosure.

FIG. 9 is a view for describing a shape of an audio accessory according to another embodiment of the present disclosure.

Referring to FIG. 9, the audio accessory 200 may be provided in a form in which an elastic body 300 and an audio output module 230 are integrated with each other. For example, a configuration in which a cable 220 and the audio output module 230 are connected with each other and then the elastic body 300 may be injection molded to be fitted on the audio output module 230 so as to provide the audio accessory 200. Since the audio accessory 200 of such a configuration is provided such that the elastic body 300 and other components are integrated through injection molding, the audio accessory 200 is less troubled. In addition, since a separate assembling operation is not performed, a manufacturing process of a product may be further simplified. In addition, since the elastic body 300 is injection-molded based on the audio output module 230, an electric contact structure between the audio output module 230 and the elastic body 300 may be stably provided and maintained.

Figure 10:
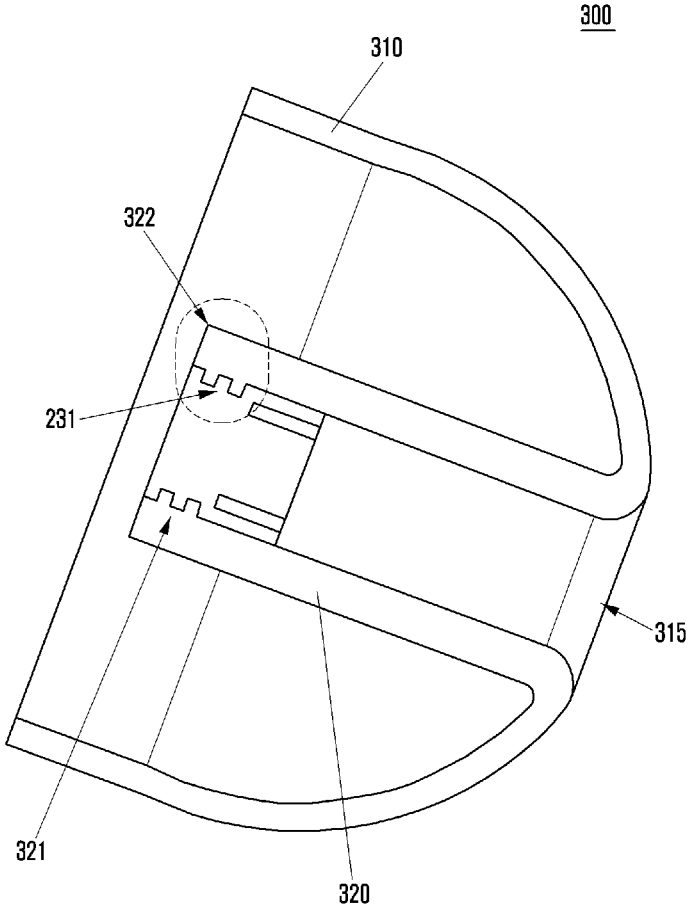
FIG. 10 is a view for describing a coupling structure between an audio output module and an elastic body according to an embodiment of the present disclosure.

FIG. 10 is a view for describing a coupling structure between an audio output module and an elastic body according to an embodiment of the present disclosure.

Referring to FIG. 10, the elastic body 300 may be provided in a form in which an outer cover 310 and an inner cover 320 are connected with each other with reference to a sound hole 315. An audio output module 230 may be disposed inside the inner cover 320. After being provided separately, the audio output module 230 may be fixedly inserted into the inside of the inner cover 320. The audio output module 230 may be provided with a bolt structure 231 on an exterior case of the audio module 230. The bolt structure 231 may be formed in at least a part of the exterior case. For example, the bolt structure 231 may be partially formed on a portion of the exterior case where the audio output module 230 is connected with the cable 220.

A nut structure 321 may be formed on at least a part of the inside of the inner cover 320. The nut structure 321 may be formed on a portion adjacent to the bottom surface 322 of the inner cover 320 bottom surface 322. The nut structure 321 may not be formed on the bottom surface 322 such that the audio output module 230 to be coupled is not released from the bottom surface 322 of the inner cover 320. The nut structure 321 of the inner cover 320 may be formed in a shape protruding from the wall surface of the inner cover 320. The diameter of the inner cover 320 may be equal to or larger than that of the audio output module 230.

In the audio accessory 200 configured as described above, the cable connected to the audio output module 230 is inserted first toward the sound hole 315 of the elastic body 300, and according to the movement of the cable, the audio output module 230 may be inserted into the sound hole 315. Thereafter, in response to additional movement of the cable, the audio output module 230 may be moved from the top end surface of the inner cover 320 toward the bottom surface 322. When the bolt structure 231 of the audio output module 230 and the nut structure 321 of the inner cover 320 come into contact with each other, the audio output module 230 may be coupled in the vicinity of the bottom surface 322 of the inner cover 320 by screwing.

In the foregoing description, a construction in which the bolt structure 231 is provided on the exterior case of the audio output module 230 and the nut structure 321 is provided on the inner cover 320 has been disclosed. However, various embodiments of the present disclosure are not limited to this. For example, the above-described bolt structure 231 and nut structure 321 may be substituted with a hook recess and a hook.

Figure 11A:
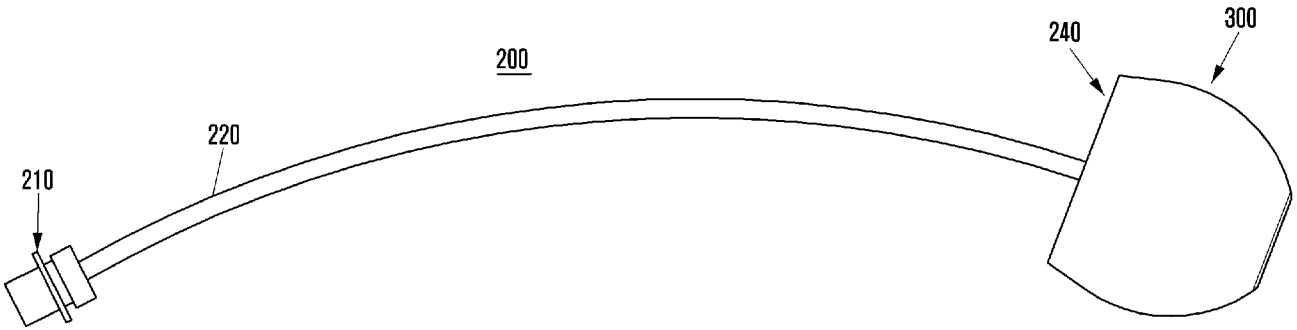
FIGS. 11A, 11B, and 11C are views illustrating arrangements of sensors of audio accessories according to an embodiment of the present disclosure.
Figure 11B:
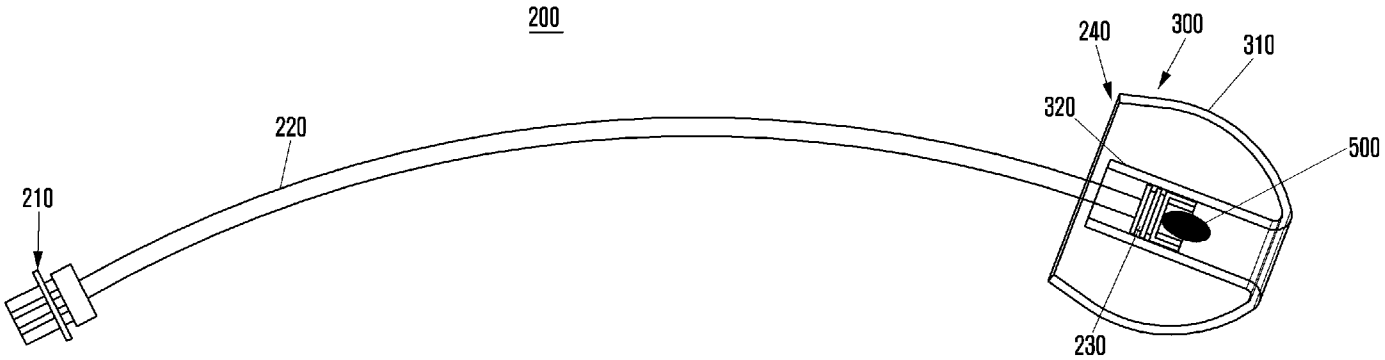
Figure 11C:
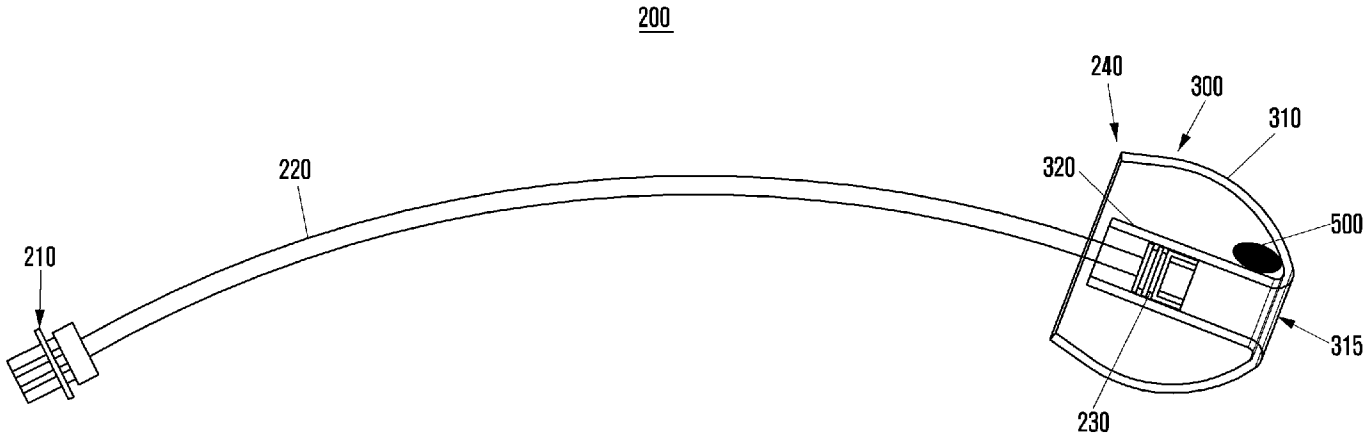

FIGS. 11A to 11C are views illustrating arrangements of sensors of audio accessories according to various embodiment of the present disclosure.

Referring to FIGS. 11A and 11B, an audio accessory 200 according to an embodiment of the present disclosure may include a connector 210, a cable 220, and an elastic body 300 that encloses an audio output module 230. In addition, the audio accessory 200 may include a sensor module 500 which is capable of generating a sensor signal in response to a positional change within an ear.

The sensor module 500 may be disposed inside an inner cover 320 of the elastic body 300, for example, in the vicinity of the audio output module 230. The sensor module 500 may be disposed at a position opened toward the external auditory meatus through a sound hole 315. The sensor module 500 may transmit a sensor signal toward the sound hole 315 and receive a reception signal corresponding thereto. The sensor module 500 may include a sensor capable of sensing a environmental change within the ear, for example, a change of air such as illumination, temperature, and moisture. The sensor module 500 may include a sensor capable of sensing a distance within the ear by sensing a reflection signal or a frequency. For example, the sensor module 500 may be constituted with at least one of an illumination sensor, a temperature sensor, a moisture sensor, an infrared ray sensor, and a frequency sensor. The sensor module 500 may generate signal sensors corresponding to a position and a condition of the audio output module 230. The sensor signals collected by the sensor module 500 may be transmitted to the audio output module 230 or to the electronic device 100 through the cable 220.

Referring to FIGS. 11A and 11C, an audio accessory 200 according to an embodiment of the present disclosure includes a connector 210, a cable 220, and an elastic body 300 that encloses an audio output module 230, and a sensor module 500 capable of sensing a positional change of a header module 240 within the ear may be disposed between an outer cover 310 and an inner cover 320.

Even if the sensor module 500 is disposed between the outer cover 310 and the inner cover 320 of the elastic body 300, the sensor module 500 may be configured as a contactless type sensor capable of sensing the positional change of the header module 240 within the ear. For example, the sensor module 500 may include a sensor capable of sensing at least one of illumination, infrared ray, frequency and distance. For example, the sensor module 500 may be constituted with at least one of an illumination sensor, an infrared ray sensor, and a frequency sensor.

The sensor module 500 may include a sensor capable of sensing a pressure which is changed in response to the movement of the header module 240 within the ear. The header module 240 is inserted into the inside of the ear, of which the cross-sectional area is gradually decreased. Thus upon being inserted into the ear further, the header module 240 may be positioned within a portion having a narrower cross-sectional area. Consequently, during the insertion of the header module 240 into the ear, external pressure may be gradually increased. In the case where the sensor module 500 is disposed between the outer cover 310 and the inner cover 320 of the elastic body 300, an external pressure varied depending on the position within the ear may be applied to the sensor module 500. The sensor module 500 may collect sensor signals corresponding to the varied external pressure.

FIGS. 12A to 12E are views illustrating elastic body structures according to an embodiment of the present disclosure.

Figure 12A:
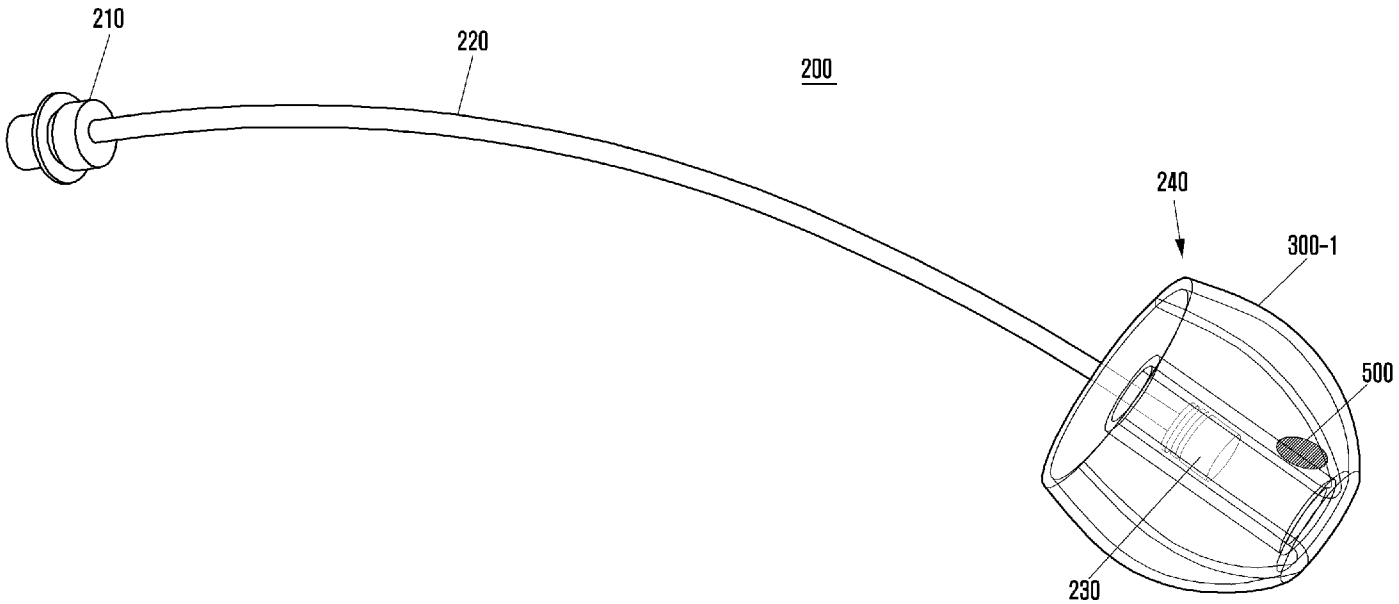
FIGS. 12A, 12B, 12C, 12D, and 12E are views illustrating elastic body structures according to an embodiment of the present disclosure.

Referring to FIG. 12A, an audio accessory 200 according to an embodiment of the present disclosure may include a connector 210, a cable 220, an audio output module 230, and a header module 240 including a second elastic body 300-2.

A first elastic body 300-1 may be formed of a transparent material through which the audio output module 230 may be observed and a sensor signal may penetrate. The sensor module 500 may be disposed between the outer cover 310 and the inner cover 320 of the first elastic body 300-1. When the first elastic body 300-1 is formed of a transparent material, signals of illumination, infrared ray, and the like, may be transmitted/received through the first elastic body 300-1. The sensor module 500 may include an illumination sensor, an infrared ray sensor, and the like.

Figure 12B:
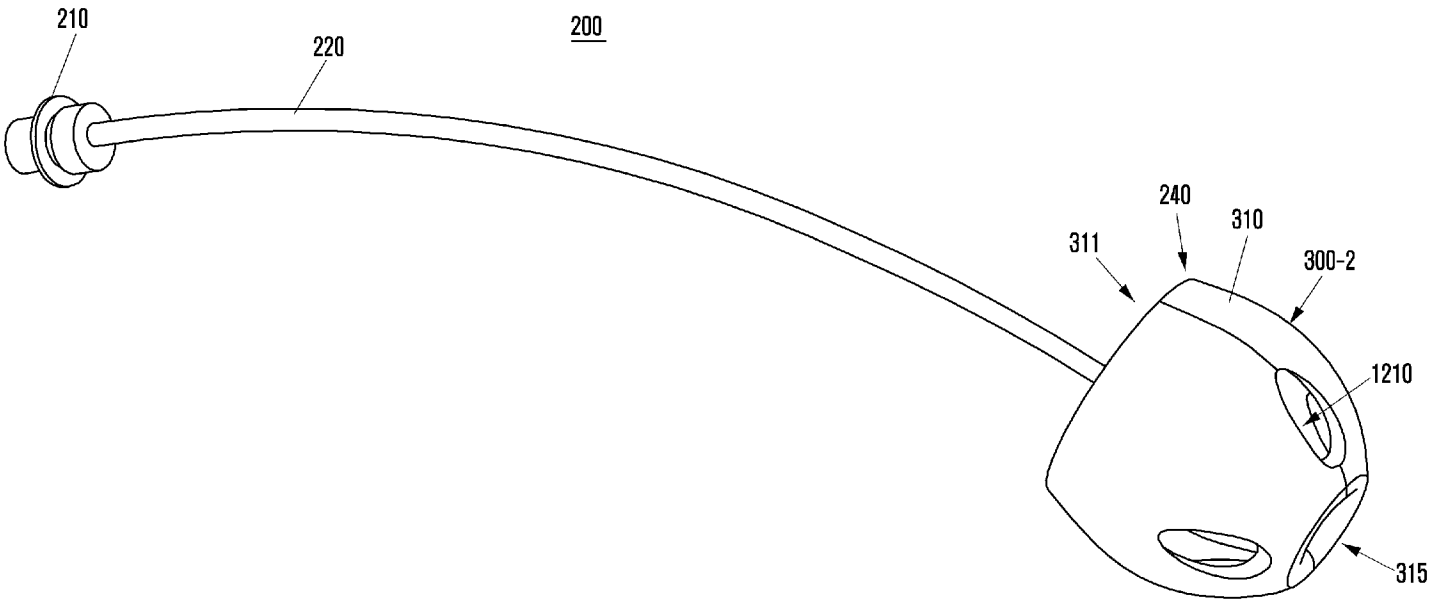

Referring to FIG. 12B, an audio accessory 200 according to another embodiment may include a connector 210, a cable 220, an audio output module, and a header module 240 including a second elastic body 300-2. The second elastic body 300-2 included in the header module 240 may include at least one first auxiliary hole 1210.

The second elastic body 300-2 may include a cylindrical inner cover having a predetermined length, an outer cover 310 provided in a mushroom-shape extending from an edge of a sound hole 315 formed in the top end surface of the inner cover. In particular, the at least one first auxiliary hole 1210 is disposed to be symmetrical with reference to the center of the sound hole 315 in a predetermined region of the outer cover 310. For example, four first auxiliary holes 1210 may be provided. The four first auxiliary holes 1210 may be disposed symmetrically with reference to the central axis of the sound hole 315 to be spaced apart from the sound hole 315.

Each of the first auxiliary holes 1210 may be provided in a form in which an area positioned adjacent to the sound hole 315 has a wider width and is narrowed toward an area positioned adjacent to the inlet 311 of the outer cover 310. For example, each first auxiliary hole 1210 may be provided in a water drop shape. At least one sensor module may be disposed on an outer surface of the inner cover exposed to the first auxiliary holes 1210. According to an embodiment, the at least one sensor module disposed on the outer surface of the inner cover may be exposed to the outside of the outer cover 310 through the first auxiliary holes 1210. The sensor module may include not only an illumination sensor, an infrared sensor and a frequency sensor but also a sensor capable of measuring a change of air within the ear such as moisture and temperature.

Figure 12C:
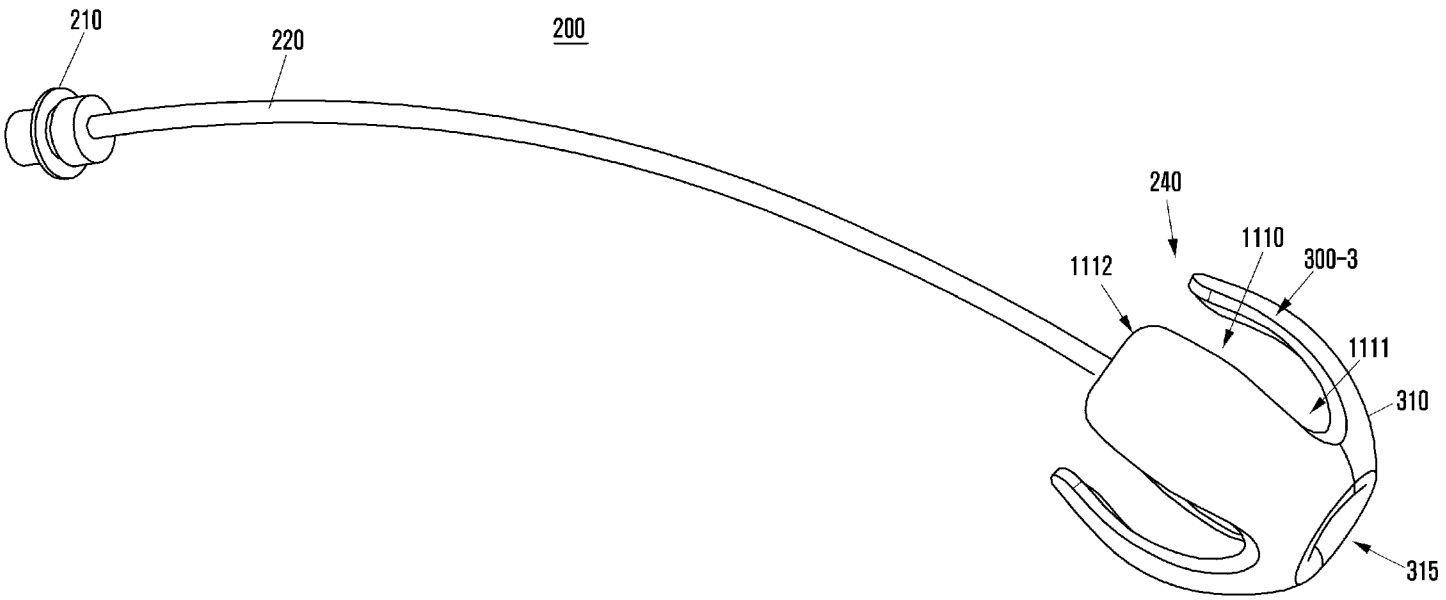

Referring to FIG. 12C, an audio accessory 200 according to still another embodiment may include a connector 210, a cable 220, an audio output module, and a header module 240 including a third elastic body 300-3. The third elastic body 300-3 included in the header module 240 may include at least one first auxiliary recess 1110. The third elastic body 300-3 may include an inner cover having a predetermined length, and an outer cover 310 having a closure shape enclosing the inner cover on the sound hole 315 in the top end surface of the inner cover.

The outer cover 310 may be provided with at least one first auxiliary recess 1110. For example, four first auxiliary recesses 1110 may be disposed symmetrically with reference to the central axis of the sound hole 315 in the outer cover 310. Each of the first auxiliary recesses 1110 may be provided by removing at least a part of the outer cover from the inlet bottom surface of the outer cover 310 toward the sound hole 315. The outer cover 310 provided with the first auxiliary recesses 1110 may include valleys 1111 and peaks 1112. A bottom surface of each of the peaks 1112 may be formed in a flat shape. Each of the valleys 1111 may be formed in a round shape. Each of side walls forming the valleys 111 of the first auxiliary recesses 1110 may be formed in a streamlined shape. For example, each of an inlet and an end of each first auxiliary recess 1110 has a size smaller than the size of the central area of the recess. One end of the deformation unit or sensing unit of the above-described distance sensing module may be disposed on the bottom surface of each peak 1112 or in an area adjacent to the bottom surface.

The peaks 1112 forming the four first auxiliary recesses 1110 may be bent toward the inner cover while a third elastic body 300-3 is being inserted into the ear. The bent extent or direction of the peaks 1112 may be varied depending on the shape of the inside of the ear. In the shape of the inside of the ear, the cross-sectional sizes of the external ear and the internal ear may be significantly different from each other. The audio output module 230 or the electronic device 100 may estimate the positional change within the ear when the peaks 1112 are bent to be equal to or larger than a predetermined extent. In the above-described operation, the peaks 1112 of the plurality of the first auxiliary recesses 1110 may support measurement such that a harmonized elasticity level may be measured while the third elastic body 300-3 is inserted into the ear. When the ends of the plurality of deformation units and sensing units are provided on the peaks 1112 to be capable of sensing a plurality of sensor signals, the third elastic body 300-3 according to the present embodiment may make it possible to determine the position within the ear more stably from the sensor signals corresponding to the peaks 1112 uniformly deformed in response to the entry into the ear or release from the ear.

Figure 12D:
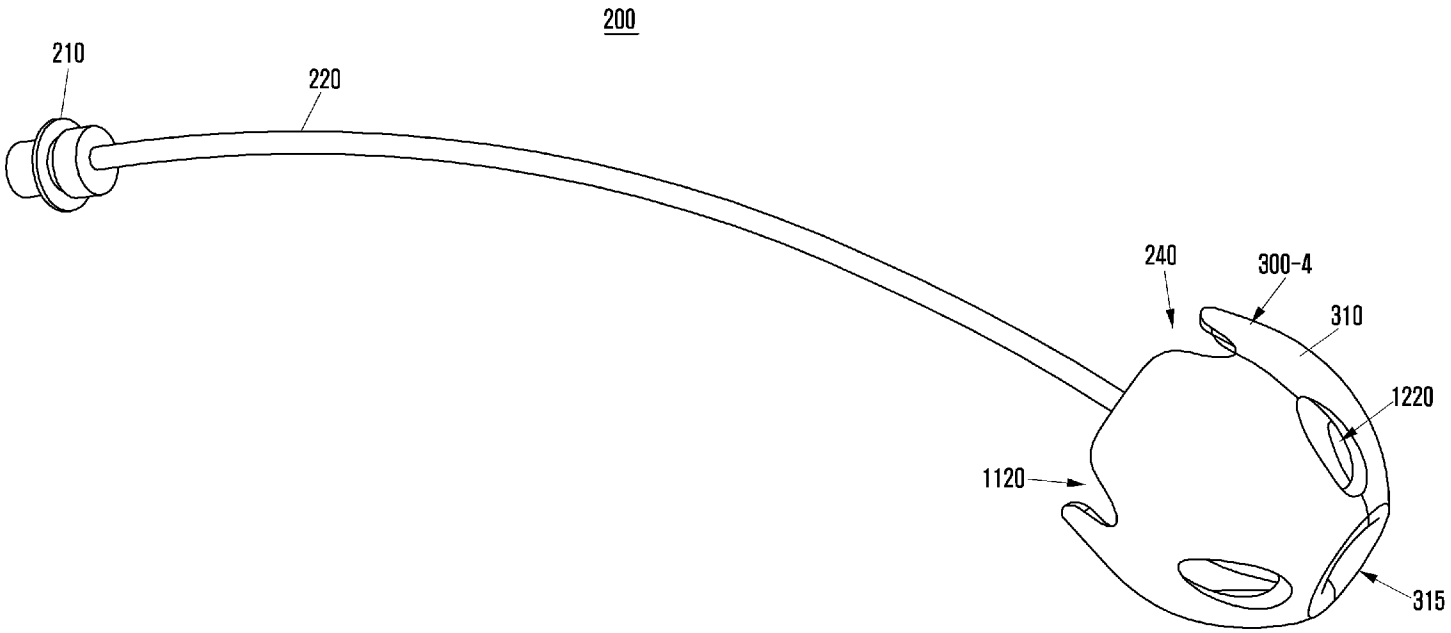

Referring to FIG. 12D, an audio accessory 200 according to an embodiment may include a connector 210, a cable 220, an audio output module, and a header module 240 including a fourth elastic body 300-4). The fourth elastic body 300-4 included in the header module 240 may include at least one second auxiliary hole 1220 and at least one second auxiliary recess 1120.

The second auxiliary hole 1220 may be formed in a shape which is the same as or similar to the first auxiliary hole 1210 illustrated in FIG. 12B. For example, the second auxiliary hole 1220 may be provided by removing a predetermined area of the outer cover 310 such that the inside of the outer cover 310 is exposed. The second auxiliary hole 1220 may be disposed in the outer cover 310 in an area adjacent to the position where a sound hole 315 is disposed. A predetermined number of second auxiliary holes 1220 may be provided. The number of the second auxiliary holes 1220 may be, for example, 2, 3, 4, 5, 6, and so on to be disposed symmetrically with reference to the central axis of the sound hole 315. FIG. 12D exemplifies a form in which four second auxiliary holes 1220 are formed. Each of the second auxiliary holes 1220 may be formed in an elliptical shape or a free closed curve shape. For example, each of the second auxiliary holes 1220 may have a water drop shape. However, various embodiments of the present disclosure are not limited to this. Each of the second auxiliary holes 1220 may be also be formed as a polygonal hole, such as a triangular hole or rectangular holes, or an oval hole such as semi-circular holes, and various patterns, for example, a star pattern, an octopus pattern, and the like.

A predetermined number of second auxiliary recesses 1120 may be provided at predetermined locations on the inlet 311 of the outer cover 310. For example, a predetermined number of second auxiliary recesses 1120 may be provided to be aligned with the second auxiliary holes 1220. When four second auxiliary holes 1220 are provided, four second auxiliary recesses 1120 may be provided. As the second auxiliary recesses 1120 are provided, a predetermined number of peaks and a predetermined number of valleys may be provided in the inlet 311 of the outer cover 310. As described above with reference to FIG. 12C, one side end of each of some components of the distance sensing module, for example, the deformation units or the sensing units, may be provided on the peaks. Each of the second auxiliary recesses 1120 may be formed in a triangular recess shape. However, various embodiments of the present disclosure are not limited to this. Each of the second auxiliary recesses 1120 may be formed as a polygonal recess such as a rectangular recess or a pentagonal shape, or as an oval recess.

Figure 12E:
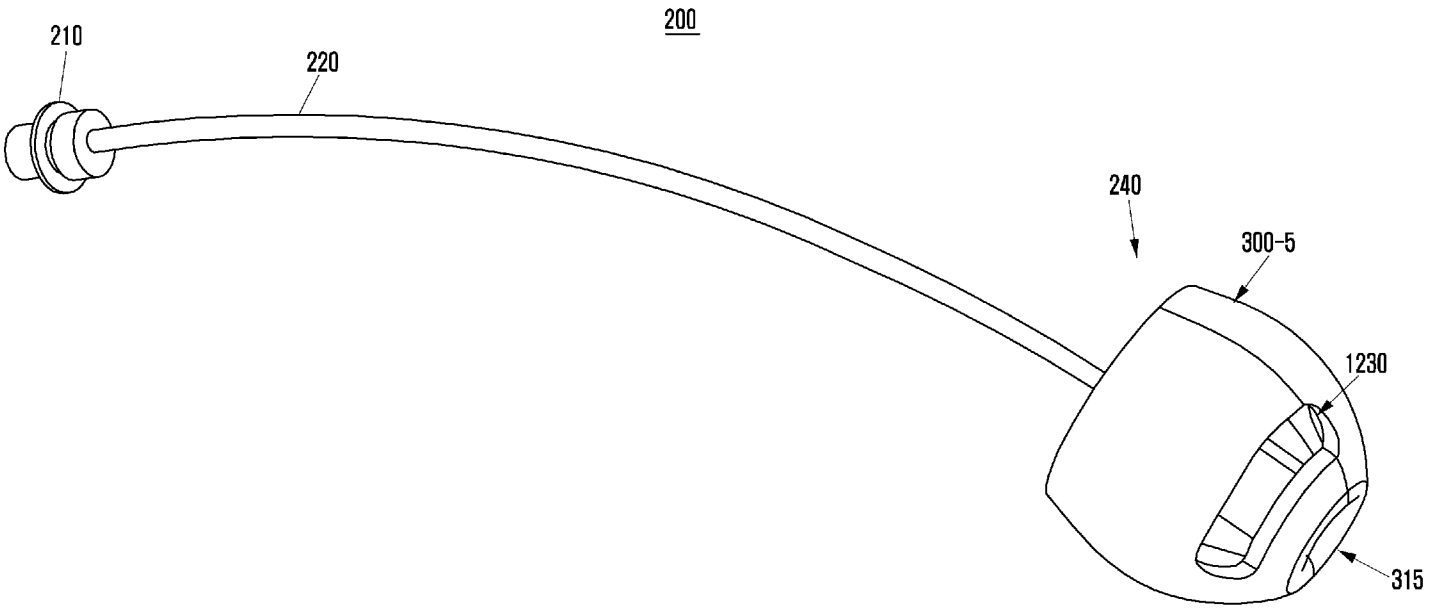

Referring to FIG. 12E, an audio accessory 200 according to yet another embodiment may include a connector 210, a cable 220, an audio output module, and a header module 240 including a fifth elastic body 300-5, and the fifth elastic body 300-5 included in the header module 240 may include at least one third auxiliary hole 1230. The third auxiliary hole 1230 may be provided by removing a part of the outer cover 310 by a predetermined length in the circumferential direction. The third auxiliary hole 1230 may be provided in an area adjacent to a sound hole 315 provided in the outer cover 310. The third auxiliary hole 1230 may be provided at a position spaced apart from the sound hole 315 to enclose a part of the edge of the sound hole 315. For example, the third auxiliary hole 1230 may be formed in a shape of a part of a band. At least a part of the inner cover 320 may be exposed through the third auxiliary hole 1230. At least one sensor may be provided on the exposed inner cover 320. The fifth elastic body 300-5 including the third auxiliary hole 1230 may allow one or more sensors to be variously disposed at various positions by securing an exposed area of the fifth elastic inner cover 320.

As described above, the audio accessories according to various embodiments of the present disclosure enable position sensing within an ear such that a situation recognition function, for example, an automatic volume adjustment function may be implemented. As the automatic volume adjustment function as the situation recognition function is implemented according to the various embodiments of the present disclosure, the ear may be protected from hearing impairment. Further, the above-described elastic body structures according to the various embodiments of the present disclosure enable stable disposition of the audio accessory within the ear and stable collection of sensor signals when they are provided for an audio accessory.

Each of the above-described devices may further include various additional modules according to the provided types thereof. For example, when any of the above-described devices is a communication device, the device may further include other constituent elements which have not been described above, for example, an interface related to data transmission/reception through a wired communication method or a wireless communication method of the device, an internet communication module which executes an internet function through communication with an internet network, and a digital broadcasting module which executes a digital broadcasting reception and reproduction function. Although such additional constituent elements are too diversified according to a convergence trend of digital devices to mention one by one, any constituent elements equivalent to those described above may be additionally included in the above-described devices. Also, it goes without saying that, in the electronic device, a particular configuration may be excluded from the above-described configuration or may be replaced by another configuration according to the form of implementation thereof. This may be easily understood by those skilled in the art to which the present disclosure pertains.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An elastic body of an audio accessory comprising:

a cylindrical inner cover;

at least one outer cover which is elongated from a top end edge of the cylindrical inner cover to enclose the cylindrical inner cover, the at least one outer cover having at least one inlet which partially exposes at least a part of the cylindrical inner cover; and at least one sensor module disposed on at least one of the cylindrical inner cover and the at least one outer cover and configured to generate a sensor signal related to deformation of at least one of the outer cover.

2. The elastic body of claim 1, wherein the at least one sensor module comprises:

a deformation unit disposed on the at least one inlet and deformed in response to the deformation of the at least one outer cover; and a reference unit disposed on a bottom surface of the cylindrical inner cover and configured to support generation of the sensor signal in response to the deformation of the deformation unit.

3. The elastic body of claim 1, wherein the elastic body of claim 1, wherein the at least one sensor module comprises:

a plurality of deformation units which are disposed on inlets of a plurality of outer covers, respectively; and a reference unit disposed on a bottom surface of the cylindrical inner cover disposed at a center of the inlets.

4. The elastic body of claim 2, wherein the at least one sensor module generates a sensor signal corresponding to a change of distance between the at least one deformation unit and the reference unit.

5. The elastic body of claim 1, wherein the at least one sensor module comprises:

a sensing unit having a first portion disposed on an inner surface of the at least one outer cover and a second portion connected to the inner surface of the at least one outer cover and disposed on an outer surface of the cylindrical inner cover.

6. The elastic body of claim 5, wherein the sensing unit generates a sensor signal corresponding to a change of distance between an end of the first portion disposed on the inner surface of the at least one outer cover and an end of the second portion disposed on the outer surface of the cylindrical inner cover.

7. The elastic body of claim 5, wherein the sensing unit generates a sensor signal related to an elasticity transformed in response to the deformation of the at least one outer cover.

8. An audio accessory comprising:

an electrically connectable connector;

a cable, one end of which is connected with the connector;

an audio output module connected with the other end of the cable and configured to output a signal transmitted thereto; and an elastic body configured to enclose the audio output module, wherein the elastic body comprises:

a cylindrical inner cover;

at least one outer cover which is elongated from a top end edge of the cylindrical inner cover to enclose the cylindrical inner cover, the at least one outer cover having at least one inlet which partially exposes at least a part of the cylindrical inner cover; and at least one sensor module disposed on at least one of the cylindrical inner cover and the at least one outer cover and configured to generate a sensor signal related to deformation of the at least one outer cover.

9. The audio accessory of claim 8, wherein the audio output module automatically adjusts an amplification level of a signal transmitted in response to the sensor signal and outputs the amplified signal.

10. The audio accessory of claim 8, wherein the audio output module performs adjustment, when a sensor signal corresponding to a contracted state of the at least one outer cover is received, the audio output module one of reduces the amplification level of the signal transmitted thereto and stops outputting of the signal, and when a sensor signal corresponding to a relaxed state of the at least one outer cover is received, the audio output module one of increases the amplification level of the signal transmitted thereto and stops outputting of the signal.

11. The audio accessory of claim 8, wherein the at least one sensor module is disposed between the at least one outer cover and the cylindrical inner cover.

12. The audio accessory of claim 8, wherein the at least one sensor module is disposed on a side of the cylindrical inner cover where the audio output module is disposed.

13. The audio accessory of claim 8, wherein the elastic body is formed of a transparent material which the signal generated by the at least one sensor module may penetrate.

14. The audio accessory of claim 8, wherein the at least one outer cover comprises:

at least one first auxiliary hole which exposes at least a part of the cylindrical inner cover where the at least one sensor module is disposed.

15. The audio accessory of claim 8, wherein the at least one outer cover comprises:

a plurality of auxiliary recesses which expose at least a part of the cylindrical inner cover where the at least one sensor module is disposed and are provided symmetrically with reference to a central axis of the cylindrical inner cover.

16. The audio accessory of claim 8, wherein the at least one outer cover comprises:

a plurality of second auxiliary holes which expose at least a part of the cylindrical inner cover where the at least one sensor module is disposed, and a plurality of second auxiliary recesses which expose at least a part of the cylindrical inner cover where the at least one sensor module is disposed and are arranged in line with the second auxiliary holes.

17. The audio accessory of claim 8, wherein the at least one sensor module comprises at least one of an illumination sensor, a temperature sensor, a moisture sensor, an infrared ray sensor, and a frequency sensor.

18. The audio accessory of claim 8, wherein the audio output module and the elastic body are formed integrally with each other.

* * * * *